US006220165B1

(12) United States Patent
Sullivan

(10) Patent No.: US 6,220,165 B1
(45) Date of Patent: Apr. 24, 2001

(54) PYROTECHNIC BRIDGEWIRE CIRCUIT

(76) Inventor: Mark K. Sullivan, P.O. Box 3418, 2400 Tanyard Rd., Joplin, MO (US) 64803-3418

( * ) Notice: Subject to any disclaimer, the term of this patent is extended or adjusted under 35 U.S.C. 154(b) by 0 days.

(21) Appl. No.: 09/215,894

(22) Filed: Dec. 18, 1998

(51) Int. Cl.[7] ..... F42B 3/12; F42B 3/11

(52) U.S. Cl. ..... 102/206; 102/202.5; 102/202.9; 102/218; 102/200

(58) Field of Search ..... 102/206, 202.5, 102/202.7, 218, 220

(56) References Cited

U.S. PATENT DOCUMENTS

| | | | | |
|---|---|---|---|---|
| H1793 | * | 4/1999 | Peterson et al. | 323/367 |
| 3,941,058 | * | 3/1976 | Gawlick et al. | 102/70.2 |
| 3,975,942 | * | 8/1976 | Dreitzler et al. | 73/35 |
| 4,395,950 | * | 8/1983 | Oswald | 102/200 |
| 4,610,203 | * | 9/1986 | Bock | 102/217 |
| 4,827,844 | * | 5/1989 | Miller | 102/220 |
| 5,335,598 | * | 8/1994 | Lewis et al. | 102/218 |
| 5,861,570 | * | 1/1999 | Bickes, Jr. et al. | 102/202.9 |

* cited by examiner

*Primary Examiner*—Michael J. Carone
*Assistant Examiner*—Lulit Samunegus
(74) *Attorney, Agent, or Firm*—Senniger, Powers, Leavitt & Roedel

(57) ABSTRACT

A circuit for controlling an electro-explosive device. The circuit includes a heating element, an input circuit and a load control circuit. The load control circuit is responsive to an electrical input provided by the input circuit for energizing the heating element. The heating element selectively causes ignition of the electro-explosive device when its level of energization reaches a firing level. The load control circuit substantially limits current in the heating element when the electrical input is less than a predetermined threshold for maintaining energization of the heating element at a level less than the firing level to prevent the ignition of the electro-explosive device. In contrast, the load control circuit applies substantially all of the electrical input to the heating element when the electrical input signal is greater than the predetermined threshold. This maintains energization of the heating element at a level greater than the firing level to cause the ignition of the electro-explosive device.

14 Claims, 4 Drawing Sheets

PYROTECHNIC BRIDGEWIRE CIRCUIT

BACKGROUND OF THE INVENTION

This invention relates generally to pyrotechnic squibs and, particularly, to a pyrotechnic squib having an improved bridgewire circuit that addresses both all-fire and no-fire requirements.

In an electrically controlled explosive system, including a pyrotechnic system, an electro-explosive device translates an electrical signal into a pyrotechnic signal for selectively beginning the detonation of an explosive material. Depending on the particular industry in which they are used, such devices are referred to by various names including squibs, initiators, ignitors and electric matches. Moreover, the pyrotechnic signals provided by the devices may take several forms (e.g., gas pressure, a flame front or a shock wave) depending on the particular use. As used herein, the term "squibs" refers to electro-explosive devices collectively.

A conventional squib includes a bridgewire that heats up in response to an electrical current. In turn, the heat generated by the bridgewire initiates detonation. The bridgewire is a resistive component, such as a wire or filament, coated or otherwise in contact with a flammable or explosive composition. This pyrotechnic composition is typically the first in a sequence of compositions of decreasing sensitivity, increasing mass and increasing energy (i.e., a pyrotechnic or explosive train). Typically, the bridgewire components are enclosed in a metal, plastic, or paper housing for maintaining the proper juxtaposition of the components. The housing also protects the pyrotechnic composition from humidity and other environmental effects. A squib operates when the current heats the bridgewire until it reaches a temperature high enough to start a chemical reaction (e.g., burning or exploding) in the first composition of the pyrotechnic train. It is to be understood that the bridgewire need not be in the actual form of a wire and may be a metal, an alloy (e.g., nichrome or tungsten) or another conducting material (e.g., semiconductor).

One shortcoming of presently available squibs is their inability to simultaneously meet fairly precise all-fire and no-fire specifications. All-fire requirements specify a minimum current and duration at which all squibs of a particular design are expected to fire (i.e., ignite to begin detonation). On the other hand, no-fire requirements specify a maximum current and duration that can be applied to the particular squibs without causing them to activate. A squib is needed that is sensitive enough to meet the former all-fire requirements but insensitive enough to meet the latter no-fire requirements. The problem is complicated by the fact that the response of a conventional squib varies with temperature, pressure, acceleration and other environmental factors. Presently available squibs can be, for example, sufficiently sensitive to meet all-fire specifications at a minimum required operating temperature but too sensitive to meet no-fire specifications at a maximum operating temperature.

Squibs are useful in ignitors, pin pullers, pin pushers, wire cutters, exploding nuts, explosive bolts, detonators, explosive bolts, rocket motors, gas generators, thermal batteries, signal flares, safe-and-arm apparatus, pressure cartridges, pyro switches, pyro valves, bellows actuators, piston actuators, perforators, air bag inflators, seat belt tensioners, and the like.

SUMMARY OF THE INVENTION

The invention meets the above needs and overcomes the deficiencies of the prior art by providing a bridgewire circuit that improves the all-fire/no-fire characteristics of a squib. Among the objects and features of the present invention may be noted the provision of an improved bridgewire circuit that limits the current through the bridgewire to a relatively small fraction of the squib input current when the input current is below a desired firing current level and passes substantially all of the input current through the bridgewire when it is above the desired firing current level; the provision of such a bridgewire circuit that determines whether the desired firing current level has been reached; the provision of such a bridgewire circuit that permits squibs to have more precise no-fire and all-fire characteristics over a wider temperature range than conventional squibs; the provision of such a bridgewire circuit that permits squibs to have improved speed and reliability; the provision of such a bridgewire circuit that permits squibs to have improved performance at low temperatures; the provision of such a bridgewire circuit that is compatible with conventional squib firing circuitry; the provision of such a bridgewire circuit that permits continuity testing of the bridgewire; and the provision of such a bridgewire circuit that is economically feasible and commercially practical.

Briefly described, an electrical system embodying aspects of the invention is for use with an electro-explosive device. The system includes a heating element and an input circuit supplied by a power supply for providing an electrical input to the system. The system also includes a load control circuit receiving and responsive to the electrical input for energizing the heating element. The heating element selectively causes ignition of the electro-explosive device when its level of energization reaches a firing level. The load control circuit substantially limits current in the heating element when the electrical input is less than a predetermined threshold. This maintains energization of the heating element at a level less than the firing level to prevent the ignition of the electro-explosive device. In contrast, the load control circuit applies substantially all of the electrical input to the heating element when the electrical input is greater than the predetermined threshold. This maintains energization of the heating element at a level greater than the firing level to cause the ignition of the electro-explosive device.

Another form of the invention is directed to a component of an electro-explosive system. The component includes an explosive material and a heating element for causing ignition of the explosive material. An input circuit supplied by a power supply provides an electrical input to the component. The component also includes a load control circuit receiving and responsive to the electrical input for energizing the heating element. The heating element selectively causes ignition of the explosive material when its level of energization reaches a firing level. The load control circuit substantially limits current in the heating element when the electrical input is less than a predetermined threshold. This maintains energization of the heating element at a level less than the firing level to prevent the ignition of the explosive material. In contrast, the load control circuit applies substantially all of the electrical input to the heating element when the electrical input is greater than the predetermined threshold. This maintains energization of the heating element at a level greater than the firing level to cause the ignition of the explosive material. Further, the component includes a housing for the explosive material, heating element, input circuit and load control circuit.

In yet another form of the invention, an electrical system is for use with an electro-explosive device. The system includes an input circuit for providing an electrical input to the system in response to a signal supplied by a power supply. A semiconductor device is connected to the input circuit for causing ignition of the electro-explosive device. The semiconductor device heats in response to the electrical input for selectively causing the ignition of the electro-explosive device when the electrical input applied to the device exceeds a firing level. The system also includes a load control circuit, which includes the semiconductor device, connected to the input circuit for controlling the electrical input.

Yet another form of the invention is directed to a method of testing continuity of a bridgewire in an electro-explosive device. The method includes the steps of connecting the bridgewire to a positive rail and a negative rail for providing an electrical input thereto and defining a forward polarity of the electrical input applied to the bridgewire with respect to the positive and negative rails. The method also includes inserting a diode in the negative rail electrically in series with the bridgewire. The diode has its cathode connected to the bridgewire. The method further includes the steps of applying a reverse polarity current to the bridgewire via the diode and measuring a voltage across the positive and negative rails to determine continuity in the bridgewire.

Alternatively, the invention may comprise various other methods and systems.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF PREFERRED EMBODIMENTS

Figure 1:
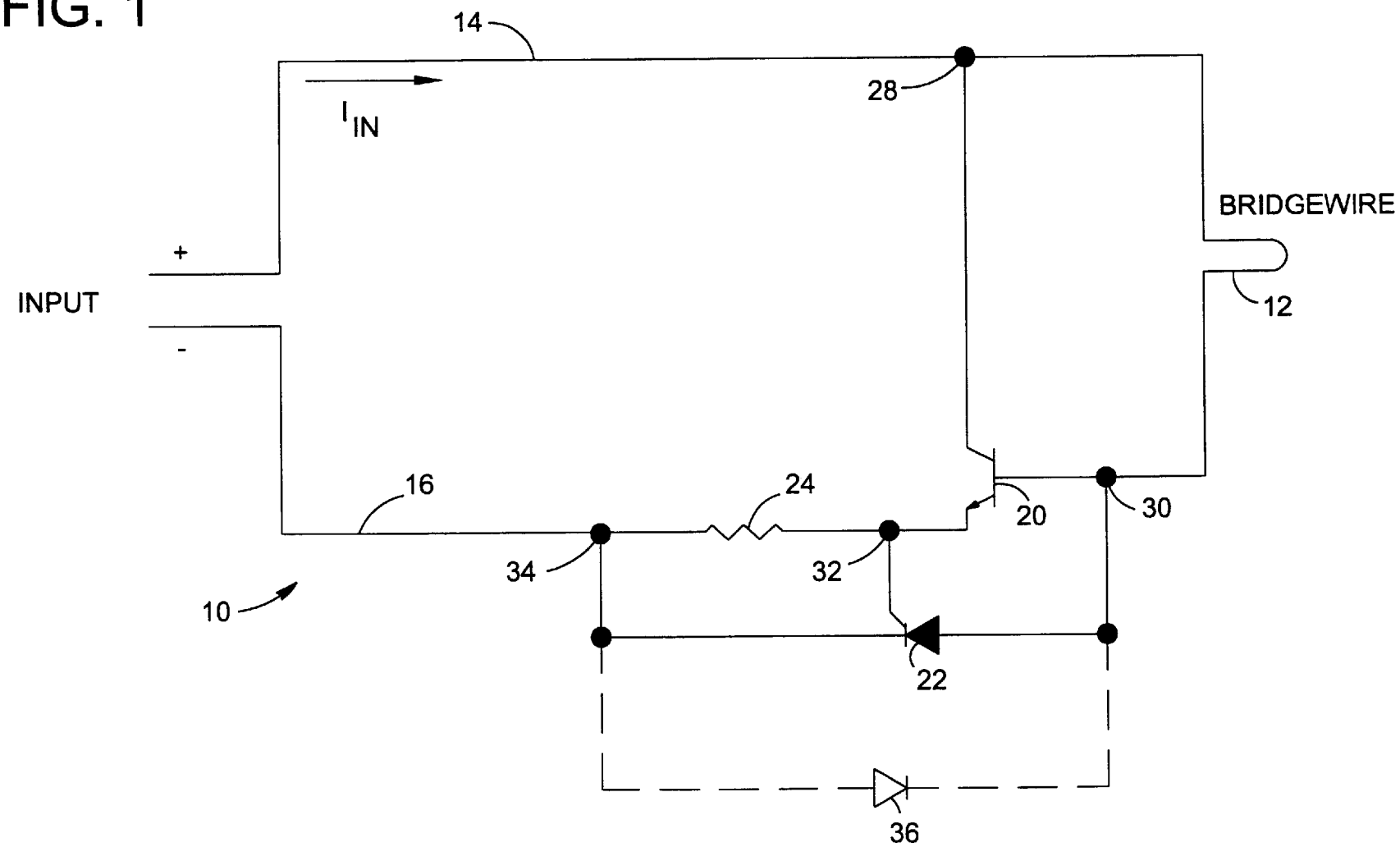
FIG. 1 is a schematic diagram of a bridgewire circuit according to a preferred embodiment of the invention.

Referring now to the drawings, FIG. 1 illustrates a squib bridgewire circuit 10 for use in firing an explosive or pyrotechnic train to detonate an explosive. The bridgewire circuit 10 includes a bridgewire 12 that heats up when energized by an electrical current. The bridgewire 12 constitutes a heating element, such as a resistive wire or filament, coated or otherwise in contact with the first flammable or explosive composition of the squib's explosive train (see FIG. 4). In turn, the heat generated by sufficient current in bridgewire 12 initiates detonation. Advantageously, bridgewire circuit 10 is compatible with conventional squib firing circuitry, which has a power supply for supplying an electrical input to bridgewire circuit 10 via an input circuit of positive and negative rails 14 and 16, respectively.

In addition to bridgewire 12, one preferred embodiment of the electronic bridgewire circuit 10 includes a first semiconductor device such as a transistor 20, a second semiconductor device such as a silicon controlled rectifier (SCR) 22 and an electrical sense resistor 24. As shown in FIG. 1, the collector and the base of transistor 20 are connected across bridgewire 12. These connections define nodes 28 and 30, respectively. The resistor 24 is in the negative rail 16 and connected electrically in series with the emitter of transistor 20. As shown, resistor 24 is connected between a node 32 at the emitter of transistor 20 and a node 34 at its opposite end. As described below, the value of resistor 24 determines the firing threshold of the squib conditioned by bridgewire circuit 10.

According to the invention, the SCR 22 cooperates with transistor 20 and resistor 24 to selectively route current to bridgewire 12. In the illustrated embodiment, the anode of SCR 22 is connected to the base of transistor 20 at node 30; the cathode of SCR 22 is connected to the negative rail 16 at node 34; and the gate of SCR 22 is connected to the emitter of transistor 20 at node 32. The voltage across resistor 24 is imposed on the gate-cathode junction of SCR 22 and, thus, controls conduction in SCR 22.

In operation, bridgewire circuit 10 receives a signal from an external firing system in the form of an electrical input current $I_{IN}$. If the input current $I_{IN}$ is below a predetermined threshold, SCR 22 remains open and the current passes through two parallel paths, one being bridgewire 12 and the base-emitter junction of transistor 20 and the other being the collector-emitter junction of transistor 20. By the operation of transistor 20, the current in the base-emitter junction and, thus, the operating current in bridgewire 12, is limited to a fraction of the total current (i.e., the reciprocal of the current gain $h_{FE}$ of transistor 20). The balance of the input current $I_{IN}$ bypasses bridgewire 12 through the collector-emitter junction of transistor 20. In particular, transistor 20 conducts but SCR 22 does not when $I_{IN}$ is less than the threshold. Thus, $$I_E = I_C + I_B = I_{IN}$$

$$I_C = h_{FE} I_B$$

$$I_{IN} = h_{FE} I_B + I_B = I_B(1 + h_{FE})$$

$$I_B = \frac{I_{IN}}{(1 + h_{FE})} \approx \frac{I_{IN}}{h_{FE}}$$

If $I_B$ is approximately equal to $I_{IN}/h_{FE}$, then the collector-emitter junction of transistor 20 conducts a relatively large amount of the input current $I_{IN}$. This effectively bypasses bridgewire 12. For a typical silicon bipolar npn transistor, $h_{FE}$ is in a range of 10 to 100 and, thus, the current fraction (i.e., the operating current) actually heating bridgewire 12 is approximately 1/10 to 1/100 of the total input current $I_{IN}$ to the bridgewire circuit 10. The small fraction of current provides the relatively high margin of protection of bridgewire 12 under no-fire conditions. Since SCR 22 is not conducting at this time, substantially all of the current $I_{IN}$ passes through resistor 24, which is in series with the two parallel circuit paths described above.

In the illustrated embodiment, the emitter current $I_E$ generates a voltage $V_R$ across resistor 24. When SCR 22 is open, substantially all of the input current $I_{IN}$ flows through resistor 24 and, thus, $I_E=I_{IN}$ and $V_R=I_{IN}R$. The voltage $V_R$ is imposed on the gate-cathode junction of SCR 22 and, thus, controls conduction in SCR 22. According to the invention, the value R of resistor 24 is selected to keep the voltage $V_R$ below the gate threshold of SCR 22 so long as $I_{IN}$ is less than the desired firing threshold. When the input current $I_{IN}$ reaches the threshold, however, the voltage $V_R$ developed across resistor 24 exceeds the gate threshold of SCR 22, which turns on SCR 22. The anode-cathode junction current latches SCR 22 in its conducting state and essentially robs the base drive of transistor 20. In other words, $I_B$ is approximately zero and the collector-emitter junction of transistor 20 reverts a high impedance condition. At this point, bridge circuit 10 connects bridgewire 12 directly to the positive and negative rails 14, 16 of the input current source. Since SCR 22 is latched on, whether it robs itself of gate drive does not determine its operation. When SCR 22 is conducting, substantially all of the input current $I_{IN}$ passes through bridgewire 12. The bridgewire current exceeds the firing level necessary for heating bridgewire 12 to a temperature sufficient to ignite or initiate the first pyrotechnic composition in the train for firing the squib. Thus, transistor 20, SCR 22 and resistor 24 constitute a load control circuit. Although illustrated as a bipolar npn transistor, it is to be understood that transistor 20 may be embodied by another type of transistor (e.g., a field effect transistor having a gate, drain and source).

As described above, the squib bridgewire circuit 10 operates with precision over a wider range of temperatures than conventional squibs. The precise threshold of SCR 22 is a function of temperature but it is possible to compensate for the change in the threshold of SCR 22 by fabricating resistor 24 from a material or sub-circuit having a negative coefficient of resistance with temperature. Advantageously, this keeps the firing current threshold of bridgewire circuit 10 within a relatively narrow range over temperature and further improves the performance of circuit 10 with respect to temperature.

As understood by one skilled in the art, a pair of transistors may be used instead of SCR 22. This may simplify implementing the bridgewire circuit 10 as an integrated circuit (IC). In a discrete application, it is also possible to use SCR 22 itself as the electrical heater element and eliminate the resistive filament or wire, bridgewire 12.

Referring further to FIG. 1, the bridge circuit 10 of the improved squib also provides simple and accurate continuity testing of bridgewire 12 with an external continuity verification circuit. If bridgewire 12 fails and becomes an open circuit, no current is present at the base-emitter junction of transistor 20. This condition causes transistor 20 to turn off, which presents an open circuit across nodes 28 and 32 (i.e., between positive rail 14 and negative rail 16). Thus, bridge circuit 10 permits detection of an open circuit bridgewire 12 by inputting a continuity testing current via rails 14, 16 to detect an open circuit condition at the input terminals of circuit 10. According to the present invention, bridge circuit 10 also permits use with different continuity testing systems. In this regard, when transistor 20 is saturated, the combined voltage drop across transistor 20 and resistor 24 does not have exactly the same response as a purely resistive bridgewire. Nonetheless, bridgewire circuit 10 may be tailored so that the voltage response is within the design specifications of conventional continuity testing systems.

An alternative testing method may be implemented by inserting a diode 36 between nodes 30 and 34. In particular, the cathode of diode 36 is connected to the base of transistor 20 and the anode of diode 36 is connected to the cathode of SCR 22. With the diode 36 added, bridgewire 12 may be tested through diode 36 by applying a reverse polarity test current to the input terminals of circuit 10. The reverse polarity condition turns off the current-bypassing function of transistor 20 but turns on the added diode 36. This allows test current to flow only through bridgewire 12. Preferably, the former method of continuity testing described above is employed when the no-fire specifications of the squib must be met independently of polarity.

The present invention permits yet another method of testing bridgewire 12. In this alternative embodiment, an input pulse of current triggers SCR 22. Although the pulse has an amplitude sufficient to turn on SCR 22, its length is short enough in duration to avoid excessive heating of bridgewire 12. After the pulse, a steady-state, low-level input current maintains SCR 22 in the conducting state without excessive heating of bridgewire 12. In this test condition, substantially all the test current passes through bridgewire 12 and the voltage drop across SCR 22 is largely independent of slight variations in current. Therefore, slight variations in the test current induce variations in the terminal voltage of circuit 10 substantially proportional to the resistance of bridgewire 12.

Figure 2:
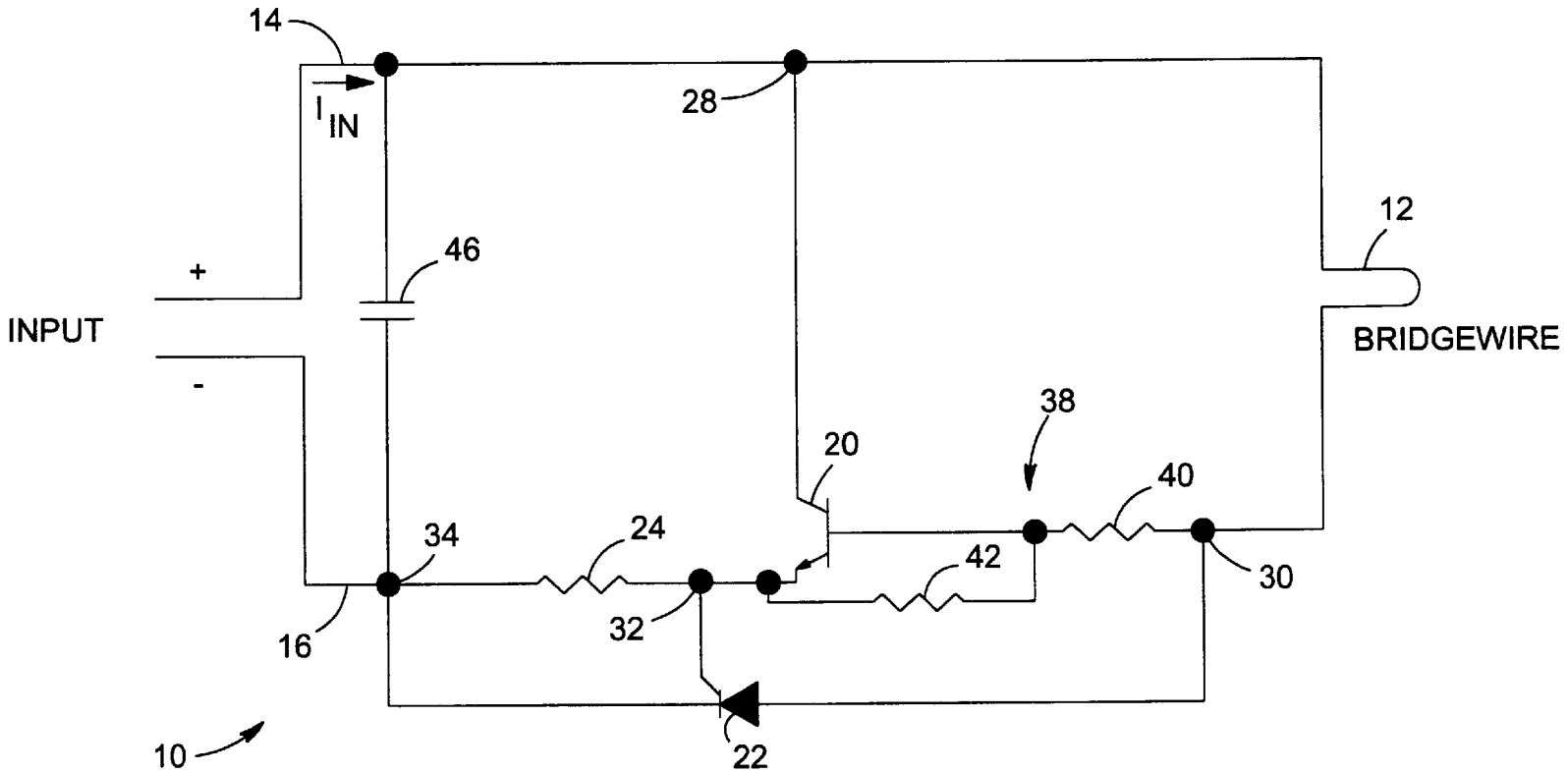
FIG. 2 is a schematic diagram of the bridgewire circuit of FIG. 1 having additional conditioning circuitry.

FIG. 2 illustrates an added voltage divider circuit 38 for the squib bridgewire circuit 10. When circuit 10 is in the firing state, the anode-cathode saturation voltage of SCR 22 minus the voltage $V_R$ across resistor 24 appears on the base-emitter junction of transistor 20. Since the saturation voltage of SCR 22 may be higher than the base threshold of transistor 20, the resistive voltage divider 38, including resistors 40 and 42 connected to the base of transistor 20, ensures that transistor 20 turns more completely off when SCR 22 turns on. Resistive divider 38 also facilitates tailoring of the continuity-test response of the improved squib. An alternative embodiment includes a diode junction inserted in series with the base of transistor 20. Either embodiment serves to increase the fraction of input current that is impressed upon bridgewire 12 to substantially the full input current $I_{IN}$.

Silicon controlled rectifiers such as SCR 22 are sensitive to firing from a high rate of change of the anode/cathode voltage. This defect might allow the improved squib to fire at currents below the desired firing threshold when the input voltage increases rapidly. This problem is minimized by selecting a small area silicon controlled rectifier die in the squib. Bypassing rapidly changing currents around the squib by the addition of a capacitor 46 across the input also provides protection. The capacitor 46 also improves the immunity of circuit 10 to radio frequency (RF) signals. Adding an inductor (not shown) in series with the input leads, preferably before capacitor 46, provides further protection from rapidly changing currents and RF signals. Although the individual application will dictate the best choice for the inductor, in most cases bulk ferrite material surrounding the input lead wires performs satisfactorily. For maximum RF immunity, the entire squib, including both electronic and pyrotechnic components may be enclosed in a magnetically and electrically conductive housing and the lead wires brought in through a filter comprising feed-through capacitors and ferrite inductors. Such RF protection measures may also be applied to the alternative embodiment described below with respect to FIG. 3. It is to understood by those skilled in the art that additional passive electrical elements may be added to reduce the sensitivity of circuit 10 to high frequency radiated signals or to fast rise-times on the input.

Figure 3:
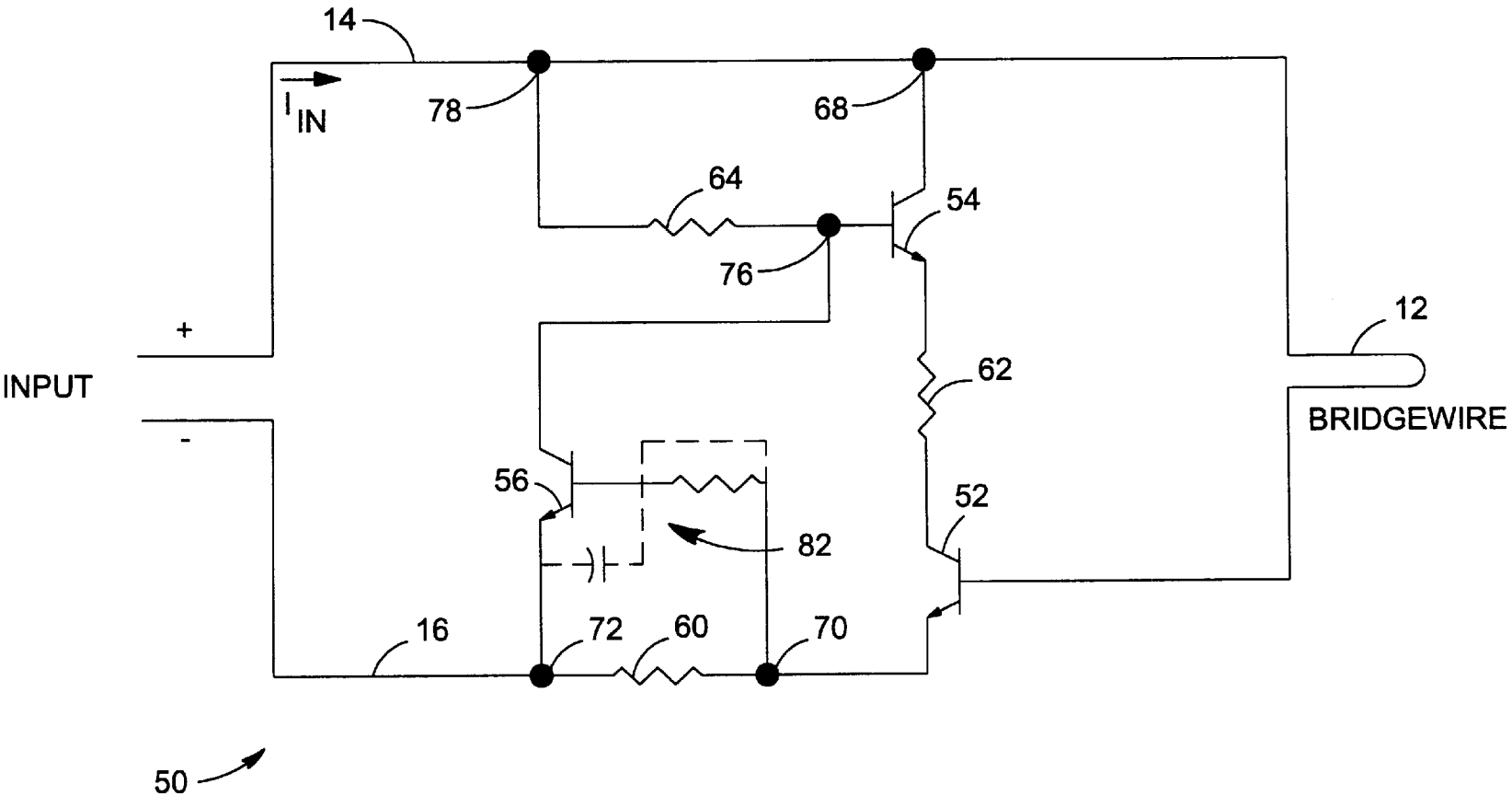
FIG. 3 is a schematic diagram of a bridgewire circuit according to another preferred embodiment of the invention.

FIG. 3 illustrates a squib bridgewire circuit 50 according to another preferred embodiment of the invention. The bridgewire circuit 50 is also compatible with conventional squib firing circuitry, which provides the input current via rails 14 and 16, for heating bridgewire 12. In addition to bridgewire 12, electronic bridgewire circuit 50 includes first, second and third transistors 52, 54 and 56, respectively, and first, second and third electrical resistors 60, 62 and 64, respectively. As shown in FIG. 3, the base of transistor 52 is connected to one end of bridgewire 12. The other end of bridgewire 12 is connected to positive rail 14 and to the collector of transistor 54 at a node 68. The resistor 60 is in the negative rail 16 and connected electrically in series with the emitter of transistor 52. As shown, resistor 60 is connected between a node 70 at the emitter of transistor 52 and a node 72 at its opposite end. As with resistor 24, the value of resistor 60 determines the firing threshold of the squib conditioned by bridgewire circuit 50. The emitter of transistor 54 is connected to the collector of transistor 52 via the resistor 62. In other words, when transistors 52 and 54 are on, they form a conduction path between the positive rail 14 at node 68 and the negative rail 16 at node 70. With respect to the transistor 56, its base-emitter junction is connected across resistor 60 at nodes 70 and 72 and its collector is connected to the base of transistor 54 at a node 76. The resistor 64 is connected to the positive rail 14 at a node 78 and to the base of transistor 54 at the node 76.

The transistor 52 operates in a manner similar to transistor 20 of FIGS. 1 and 2 for bypassing the input current from bridgewire 12. As described above, switching on SCR 22 robs transistor 20 of base current for turning it off. In this embodiment, however, switching off transistor 54 in the collector circuit of transistor 52 causes transistor 52 to turn off. In operation, bridgewire circuit 50 receives the electrical input current $I_{IN}$ from an external firing system. If the input current $I_{IN}$ is below the predetermined threshold, transistor 56 remains open and the current passes substantially through two parallel paths. In this instance, the first parallel path is bridgewire 12 and the base-emitter junction of transistor 52 and the second is the collector-emitter junctions of transistors 54 and 52 between nodes 68 and 70. By the operation of transistor 52, the current in the base-emitter junction and, thus, the current in bridgewire 12, is limited to approximately $I_{IN}/h_{FE}$. Therefore, the collector-emitter junction of transistor 52 conducts a relatively large amount of the input current $I_{IN}$ to effectively bypass bridgewire 12.

Since transistor 56 is not conducting at this time, substantially all of the current $I_{IN}$ passes through the sense resistor 60. In FIG. 3, the emitter current $I_E$ of transistor 52 generates a voltage $V_R$ across resistor 60. When transistor 56 is open, substantially all of the input current $I_{IN}$ flows through resistor 60 and, thus, $I_E=I_{IN}$ and $V_R=I_{IN}R$. The voltage $V_R$ is imposed on the base-emitter junction of transistor 56 and, thus, controls conduction in transistor 56. According to the invention, the value R of resistor 60 is selected to keep the voltage $V_R$ below the base threshold of transistor 56 so long as $I_{IN}$ is less than the desired firing threshold. When the input current $I_{IN}$ reaches the desired firing threshold, however, the voltage $V_R$ developed across resistor 60 exceeds the base threshold, which turns on transistor 56. The conducting state of transistor 56 essentially robs the base drive of transistor 54. In other words, $I_B$ for transistor 54 is approximately zero and the collector-emitter junction of transistor 54 reverts a high impedance condition. At this point, bridge circuit 50 connects bridgewire 12 directly to the positive and negative rails 14, 16 of the input current source. When transistor 54 turns off, substantially all of the input current $I_{IN}$ passes through bridgewire 12 and heats it to a temperature sufficient to ignite or initiate the first pyrotechnic composition in the train for firing the squib.

To ensure reliable operation, transistor 52 is able to pass the full input current through its base-emitter junction without opening the circuit. Since squibs are single-use devices, it is not necessary for transistor 52 to handle the relatively large base current without failure, only to do so without failing as an open circuit. As is well known in the art, the most common failure mode of a transistor is as a closed circuit so the performance of transistor 52 is satisfactory even in failure. Further, the sense resistor 60 remains in series with bridgewire 12, even after circuit 50 fires. This is necessary to keep transistor 56 turned on and, therefore, transistor 54 turned off, when circuit 50 is in the firing state.

In a preferred embodiment of the invention, resistor 62 absorbs excess input power instead of transistor 52 performing this function. This allows transistor 52 to be embodied by a less powerful device and provides the possibility of using the transistor chip itself (i.e., transistor 52) as bridgewire 12. Transistor 52 will heat with power approximately equal to 0.6 volts times the current when transistor 54 in the collector circuit of transistor 52 opens. This is possible, even in an IC implementation, as long as the bypassed-current absorbing resistor 62 is external to the IC.

Preferably, the electronic bridgewire circuit 10 or 50 of the present invention is implemented as a hybrid including discrete transistor and SCR chips and thick-film resistances assembled on a common substrate. It is further contemplated to implement the signal conditioning circuitry as a monolithic IC. Due to the nature of integrated circuit manufacturing, the embodiment of FIG. 3 provides further advantages for implementation as an IC. The threshold programming resistance can be external to the IC implementation of the squib conditioning circuit components to allow a single type of IC to be employed in a variety of applications. As well as tailoring the all-fire/no-fire response of the squib, electronics embedded in the squib can be used to provide other functions currently provided with pyrotechnic technology. For instance, a time delay may be precisely and reliably implemented by electronic means such as an RC network 82 added to the base circuit of transistor 54 in FIG. 3.

Figure 4:
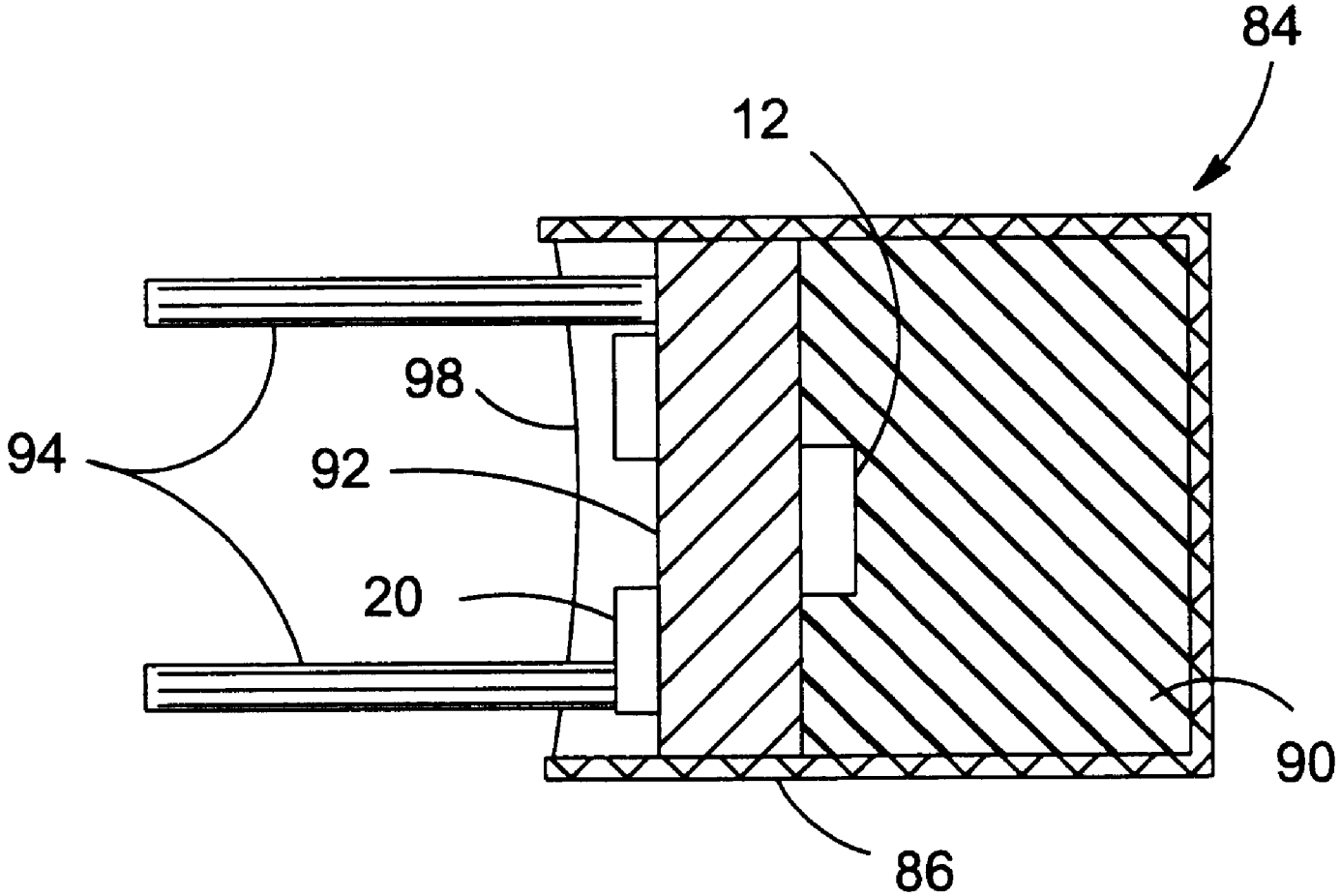
FIG. 4 is a cross-sectional view of a pyrotechnic squib according to a preferred embodiment of the invention.

The bridgewire circuits 10, 50 are preferably built into the headers and/or casings of the squibs themselves. For high-reliability applications, the respective bridgewire circuit 10 or 50 may be isolated from the pyrotechnic train by an hermetic glass seal. FIG. 4 illustrates an exemplary squib 84 including advantageous features of the present invention. As shown, the squib 84 has a housing or casing 86 for enclosing a pyrotechnic charge 90 (i.e., the first composition in the explosive train). A printed wiring or circuit board 92 carrying the conditioning circuitry of bridgewire circuit 10 or 50 may be used as the bulkhead that closes the charge cavity of casing 86 for lower cost applications of the present invention. In this embodiment of the printed wiring board 92 being used as a bulkhead, the electronic component serving as bridgewire 12, whether resistor or semiconductor device, is mounted on the charge side of printed wiring board 92 and in intimate contact with or even coated with the first composition of the explosive train (i.e., the pyrotechnic charge 90). Moreover, the electronic components that dissipate the bypassed current in the no-fire state (e.g., transistors 20 or 52 and/or resistor 62) are preferably located on the side of printed wiring board 92 that is opposite charge 90. Printed wiring board 92 is, for example, an epoxy/glass laminate or other insulative material to further protect charge 90 from initiation under no-fire conditions. A pair of lead wires 94 project from a potting compound 98 (e.g., epoxy) which seals the cavity of squib 84. The lead wires 94 define rails 14, 16 of the respective bridgewire circuit 10, 50 and provide connections to the input power source. If no-fire tests are of a relatively long duration, it may also be advantageous to ensure that the potting compound 98 have low thermal resistance so that it conducts the dissipated heat into the casing 86.

It is to understood by those skilled in the art that other embodiments of the present invention are contemplated with an understanding of the above-described principals of bypassing a portion of the current to bridgewire 12 with a transistor and either shorting the transistor's base or opening its collector to fire the squib.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An electrical system for use with an electro-explosive device comprising:

a heating element;

an input circuit supplied by a power supply for providing an electrical input to the system;

a load control circuit receiving and responsive to the electrical input provided by the input circuit for energizing the heating element, said heating element selectively causing ignition of the electro-explosive device when its level of energization reaches a firing level, said load control circuit substantially limiting current in the heating element when the electrical input provided by the input circuit is less than a predetermined threshold thereby maintaining energization of the heating element at a level less than the firing level to prevent the ignition of the electro-explosive device and said load control circuit applying substantially all of the electrical input to the heating element when the electrical input provided by the input circuit is greater than the predetermined threshold thereby maintaining energization of the heating element at a level greater than the firing level to cause the ignition of the electro-explosive device;

said load control circuit further comprising a first semiconductor device and a second semiconductor device, said first and second semiconductor devices each having a conducting state and a nonconducting state, said first device being connected to the input circuit and to the heating element for substantially limiting current to the heating element when the first device is in its conducting state and substantially passing current to the heating element when the first device is in its nonconducting state, said second device being connected to the input circuit and connected to the first device for determining the state of the first device; and wherein the conducting state of the second device is based on the electrical input provided by the input circuit being greater than the predetermined threshold and the nonconducting state of the first device is based on the conducting state of the second device.

2. The system of claim 1 wherein the first device is a transistor having a base/gate electrode and wherein the second device is connected to the transistor so that the conducting state of the second device robs the base/gate electrode current thereby causing the transistor to be in its nonconducting state.

3. The system of claim 1 wherein the first device is a transistor having a collector/drain circuit and wherein the second device is connected to the transistor so that the conducting state of the second device opens the collector/drain circuit thereby causing the transistor to be in its nonconducting state.

4. The system of claim 1 wherein the first device comprises a bipolar npn transistor.

5. The system of claim 1 wherein the first device is also the heating element.

6. The system of claim 1 wherein the heating element comprises a resistive bridgewire.

7. The system of claim 1 wherein the predetermined threshold is greater than the firing level at which ignition of the electro-explosive device is caused and wherein the load control circuit includes a resistor connected to the input circuit for setting the predetermined threshold.

8. The system of claim 1 further comprising an RC circuit for delaying the ignition of the electro-explosive device after the electrical input provided by the input circuit reaches the predetermined threshold.

9. The system of claim 1 further comprising a printed wiring board, said input circuit and load control circuit being fabricated on the printed wiring board, said printed wiring board enclosing at least a portion of the electro-explosive device.

10. An electrical system for use with an electro-explosive device comprising:

a heating element;

an input circuit supplied by a power supply for providing an electrical input to the system;

a load control circuit receiving and responsive to the electrical input provided by the input circuit for energizing the heating element, said heating element selectively causing ignition of the electro-explosive device when its level of energization reaches a firing level, said load control circuit substantially limiting current in the heating element when the electrical input provided by the input circuit is less than a predetermined threshold thereby maintaining energization of the heating element at a level less than the firing level to prevent the ignition of the electro-explosive device and said load control circuit applying substantially all of the electrical input to the heating element when the electrical input provided by the input circuit is greater than the predetermined threshold thereby maintaining energization of the heating element at a level greater than the firing level to cause the ignition of the electro-explosive device; and said load control circuit further comprising a first semiconductor device and a second semiconductor device, said first and second semiconductor devices each having a conducting state and a nonconducting state, said first device being connected to the input circuit and to the heating element for substantially limiting current to the heating element when the first device is in its conducting state and substantially passing current to the heating element when the first device is in its nonconducting state, said second device comprising a silicon controlled rectifier and having a conducting state and being connected to the input circuit and connected to the first device for determining the state of the first device based on the electrical input circuit.

11. The system of claim 10 wherein the silicon controlled rectifier is also the heating element.

12. A method of testing continuity of a bridgewire in an electro-explosive device, said method comprising the steps of:

connecting the bridgewire to a positive rail and a negative rail for providing an electrical input thereto;

defining a forward polarity of the electrical input applied to the bridgewire with respect to the positive and negative rails;

inserting a diode in the negative rail electrically in series with the bridgewire, said diode having its cathode connected to the bridgewire;

applying a reverse polarity current to the bridgewire via the diode; and measuring a voltage across the positive and negative rails to determine continuity in the bridgewire.

13. An electrical system for use with an electro-explosive device comprising:

a heating element;

an input circuit supplied by a power supply for providing an electrical input to the system;

a load control circuit receiving and responsive to the electrical input provided by the input circuit for energizing the heating element, said heating element selectively causing ignition of the electro-explosive device when its level of energization reaches a firing level, said load control circuit substantially limiting current in the heating element when the electrical input provided by the input circuit is less than a predetermined threshold thereby maintaining energization of the heating element at a level less than the firing level to prevent the ignition of the electro-explosive device and said load control circuit applying substantially all of the electrical input to the heating element when the electrical input provided by the input circuit is greater than the predetermined threshold thereby maintaining energization of the heating element at a level greater than the firing level to cause the ignition of the electro-explosive device; and wherein the electrical input is a continuity testing current that is less than the firing level at which ignition of the electro-explosive device is caused.

14. An electrical system for use with an electro-explosive device comprising:

a heating element;

an input circuit supplied by a power supply for providing an electrical input to the system, said input circuit further comprising:

a positive rail connected to one end of the heating element and a negative rail connected to another end of the heating element; and a diode in the negative rail having its cathode connected to the heating element for use in testing the heating element by applying a reverse polarity electrical input to the rails; and a load control circuit receiving and responsive to the electrical input provided by the input circuit for energizing the heating element, said heating element selectively causing ignition of the electro-explosive device when its level of energization reaches a firing level, said load control circuit substantially limiting current in the heating element when the electrical input provided by the input circuit is less than a predetermined threshold thereby maintaining energization of the heating element at a level less than the firing level to prevent the ignition of the electro-explosive device and said load control circuit applying substantially all of the electrical input to the heating element when the electrical input provided by the input circuit is greater than the predetermined threshold thereby maintaining energization of the heating element at a level greater than the firing level to cause the ignition of the electro-explosive device.

* * * * *